US009908023B1

(12) United States Patent
Hamm et al.

(10) Patent No.: US 9,908,023 B1
(45) Date of Patent: Mar. 6, 2018

(54) RETRACTABLE GARAGE DOOR BALL BOUNCE BACK SYSTEM

(71) Applicants: Michael C. Hamm, West Chester, PA (US); Andrew D. Martin, Coopersburg, PA (US)

(72) Inventors: Michael C. Hamm, West Chester, PA (US); Andrew D. Martin, Coopersburg, PA (US)

( * ) Notice: Subject to any disclaimer, the term of this patent is extended or adjusted under 35 U.S.C. 154(b) by 0 days.

(21) Appl. No.: 14/594,882

(22) Filed: Jan. 12, 2015

Related U.S. Application Data

(60) Provisional application No. 61/925,811, filed on Jan. 10, 2014.

(51) Int. Cl.
*A63B 69/00* (2006.01)

(52) U.S. Cl.
CPC ..... *A63B 69/0097* (2013.01); *A63B 2210/58* (2013.01); *A63B 2225/09* (2013.01)

(58) Field of Classification Search
CPC ..... A63B 71/02; A63B 69/00; E04H 4/06
USPC ..... 473/197, 421, 435, 493; 273/396; 4/504
See application file for complete search history.

(56) References Cited

U.S. PATENT DOCUMENTS 3,456,945 A 7/1969 Epply
4,153,246 A * 5/1979 Byrne ..... A63B 63/00 160/113
4,211,406 A * 7/1980 Roesler ..... A63B 67/04 211/14
4,776,588 A * 10/1988 Crowley ..... A63B 61/02 473/493
4,973,059 A * 11/1990 Stewart ..... A63B 61/02 473/493
5,007,645 A * 4/1991 Weigl ..... A63B 63/00 273/407
5,116,056 A 5/1992 Schmutte
5,215,310 A * 6/1993 Allbright ..... A63B 61/02 473/493
5,277,430 A 1/1994 Naccarato
5,407,178 A 4/1995 Long
D361,609 S 8/1995 Bartlett
5,571,266 A 11/1996 Nichols
5,664,784 A * 9/1997 Redlich ..... A63B 69/0097 273/396
5,680,893 A 10/1997 Neer
(Continued)

*Primary Examiner* — Aarti B Berdichevsky
*Assistant Examiner* — Christopher Glenn
(74) *Attorney, Agent, or Firm* — Clinton H. Wilkinson; Charles A. Wilkinson

(57) ABSTRACT

A retractable ball return system having a rebounding surface that is retractable on a roll back into a reel assembly housing, which housing is mountable above a garage door opening or in an open space such as a gymnasium. The rebounding apparatus includes an integrated cable support structure, which is securable at its lower corners to attachment members mounted to the garage door frame. The door frame attachments have a plurality of different connection points which allow the rebounding surface to be secured at different degrees of angle, from angling forward to angling back, or centered in the middle for a perpendicular setting. Once connected, the support cable is retracted, either manually or mechanically, to pull the cable taught, to allow for a strong support structure. The rebounding surface is also then retracted until it has a desired tension level to allow the rebounding surface to be used with different balls as well as to adjust the different performance levels with the same ball.

11 Claims, 4 Drawing Sheets

(56) References Cited

U.S. PATENT DOCUMENTS

| | | | | |
|---|---|---|---|---|
| 5,876,291 | A | 3/1999 | Dubose | |
| 5,947,831 | A * | 9/1999 | McCarthy | A63B 63/00 473/197 |
| 5,993,334 | A | 11/1999 | McNamara | |
| 6,189,889 | B1 | 2/2001 | Yip | |
| 6,248,030 | B1 * | 6/2001 | Pierce | A63B 61/02 473/490 |
| 6,482,112 | B1 * | 11/2002 | Betz | A63B 71/022 473/421 |
| 6,793,595 | B1 * | 9/2004 | Monnet | A63B 63/004 473/478 |
| 6,935,971 | B2 | 8/2005 | Piras et al. | |
| 6,969,068 | B1 | 11/2005 | Pollon et al. | |
| 7,293,776 | B2 | 11/2007 | Fenwick | |
| 7,297,076 | B2 * | 11/2007 | Pohrer | A63B 61/00 473/415 |
| 7,530,909 | B2 | 5/2009 | Thomas et al. | |
| 7,958,925 | B2 | 6/2011 | Murray | |
| 8,113,968 | B2 | 2/2012 | Fittler | |
| 8,800,157 | B2 * | 8/2014 | Lorhpipat | A63B 61/04 33/613 |
| 2002/0134618 | A1 | 9/2002 | Anderson | |
| 2002/0151387 | A1 | 10/2002 | Henson | |
| 2003/0186792 | A1 * | 10/2003 | Keeler | A63B 21/0004 482/129 |
| 2010/0186159 | A1 * | 7/2010 | Dalickas | E04H 4/06 4/504 |
| 2012/0129633 | A1 * | 5/2012 | Chen | A63B 69/0097 473/435 |
| 2012/0208658 | A1 | 8/2012 | Christgau et al. | |
| 2012/0322567 | A1 | 12/2012 | Manieri | |

* cited by examiner

RETRACTABLE GARAGE DOOR BALL BOUNCE BACK SYSTEM

CROSS-REFERENCE TO RELATED APPLICATIONS

This application claims the benefit of U.S. Provisional Application Ser. No. 61/925,811 filed Jan. 10, 2014, the entirety of which application is incorporated herein by reference.

FIELD OF THE INVENTION

The present invention relates generally to sports training aids and practice devices, and more particularly to ball rebounder, bounce back, or return devices, and more particularly still to a retractable ball rebounder, bounce back or return device which can be suspended over a garage door opening or other space, having tension and angle adjustment capability and being adaptable for use with a variety of different sports and practice scenarios.

BACKGROUND OF THE INVENTION

Ball rebounder or bounce back devices for returning or rebounding game balls such as lacrosse, tennis and baseballs have long been available. Most rebounder or bounce-back devices are portable and are designed to be set up in a yard area, and generally consist of an elastic or tensioned netting or screen which serves as the bounce back surface and is secured in a lightweight metal frame. Although effective for returning or rebounding balls when forcibly thrust into contact with the bounce back surface, such rebounding devices have several inherent drawbacks.

In particular, while sports and game balls are available in many different sizes, weights, and densities, the bounce back surface in most known ball rebounder devices is only suited for use with certain types of sporting balls. Yard-deployed rebounders are also cumbersome to move or break down, and require a significant amount of time to deploy and then store again after each use. As a result, such devices are often left out in the yard even when not in use, where in addition to being generally unsightly, they are obstruent with respect to other uses of the yard and to performing maintenance of the yard, not to mention killing the grass underneath the apparatus. Also, if left outdoors unprotected over long periods, continual subjection to elements such as the wind, rain, and sun will cause the materials to prematurely wear out or lose their original performance. Even if stored in a garage or shed, the bounce back frame takes up an inordinate amount of space and is clumsy to store, and often ends up leaning or falling on and possibly damaging other stored items such as vehicles, windows, and the like.

An alternative to conventional freestanding yard bounce back devices is to temporarily secure a net or screen over an open space such as a garage door opening. See, for example, U.S. Pat. No. 4,152,246 issued to Byrne, which discloses a reel hung sports net, and U.S. Pat. No. 5,664,784 issued to Redlich et al., which discloses a sports net that is secured over a garage door opening frame by a plurality of eye bolts, screw hooks, and adjustable straps. U.S. Pat. No. 5,993,334 issued to McNamara discloses a hockey target backdrop which can be raised and lowered between a folded storage position and an unfolded use position. U.S. Pat. No. 6,969,068 issued to Pollon et al. also discloses a retractable sports practice target which is securable to a garage door frame. U.S. Pat. No. 7,293,776 issued to Fenwick discloses a sports practice target having a plurality of target holes for collecting projectiles as they contact the target, and adapted to be supported from the lower edge of a garage door when raised. Finally, U.S. Patent Appln. Pub. 2002/0151387 filed by Henson also discloses a sports target apparatus which is removably connectable to a support structure such as a garage door opening.

These sports nets or targets while presumably suited for their particular purposes also have inherent disadvantages. A first problem is encountered in adjusting and maintaining a sufficient tension on the rebounding surface so that it is taut enough to provide the desired bounce back effect, as compared to non-tensioned nets in which case balls thrown at the net will simply be absorbed into the net. A second problem is the ability to easily adjust the angle of the bounce back screen or net depending upon the intended use, such as to simulate a fly ball or a ground ball or simply to rebound a ball back to the user. The rebounding device should also be easy to set up for use and stored when not in use without requiring tedious manual securing and unsecuring of the screen in the opening.

Recognizing the deficiencies associated with existing ball bounce back or return devices, the present inventor has now developed a retractable ball rebounding or return device that is simple and easy to set up for use and to break down and store when finished, that requires a minimum number of connections, that enables the angle of the rebounding surface and therefore the angle of return of balls thrown or directed at the rebounding surface to be easily adjusted, and that allows the tension of the rebounding surface to be easily varied so the device can be used with a wide range of sporting balls and practice scenarios, including indoor or outdoor settings.

BRIEF SUMMARY OF THE INVENTION

It is therefore an object of the present invention to provide a ball rebounding, bounce back, or return device that in an embodiment is suitable not only for use with lacrosse and baseball, but also for other sports such as soccer, basketball, street hockey, tennis, racketball, softball, or practically any sport involving a round or even nonround balls.

It is another object of the present invention to provide a ball rebounding system and apparatus in which in one embodiment the amount of tension on the rebounding surface is adjustable to accommodate use with balls having different sizes, weights, and densities, ranging from a small dense baseball to a large, soft and less dense basketball.

It is still another object of the present invention to provide a ball bounce back or return device in which in an embodiment the use position or angle of the bounce back surface is adjustable in order to vary the bounce back or return angle of a ball forcibly brought into contact with the screen. In at least one embodiment, the bounce back or return angle of the rebounding surface can be alternatively moved to a positive or negative angle, to create an upward return or a downward return, or can be kept at a perpendicular angle to achieve a direct return. This allows for simulation of a wide variety of practice or play scenarios.

It is still another object of an embodiment of the present invention to provide a retractable ball rebounding system having an integral cable frame which surrounds and supports the entire rebounding surface. In one embodiment, the cable frame requires only two connection points at the bottom left and right corners of the rebounding surface, thus limiting the number of unsightly connection points, and providing a significant time savings in securing the rebounding surface to a support framework while also ensuring consistent performance. Provision of a limited number of connection points also allows the rebounding surface to be deployed in different sized openings or a single opening.

It is still another object of the present invention to provide a retractable ball return system having in one embodiment a built-in cable frame that allows the entire bounce back to be supported by a cable that has only two connection points to a support surface, both of which retract into a housing, so that the rebounding surface and associated hardware is stored and hidden in the housing when not in use. In a preferred embodiment, no attachment points for the rebounding surface are required on the garage floor or adjacent driveway or ground surface. This allows for the ball return system to be set up in any garage application, whether the floor is made of new or old concrete, asphalt, or stone.

It is still another object of the present invention to provide a retractable ball return system which in at least one embodiment can be suspended from a deck or side of a building, such as outdoors under a deck or back wall of a house or building. In addition, in at least one embodiment the system may be used in interior applications, such as gymnasiums in schools and colleges. In another embodiment, the invention includes one or more adjustable connection brackets attached to the walls or floors of a gymnasium. Decorative indicia such as a school logo or sponsor company may be applied to the rebounding surface of the ball return system, which may then be displayed at sporting events, adding a dual purpose to the system.

It is still another object of the present invention to provide in an embodiment a retractable ball rebounding or return system that is positionable for use in a location over or covering a garage door opening, which location is convenient and already preferred by children for athletic play with balls, particularly where yard space is limited. The present invention also provides a higher quality bounce back or rebounding surface, which also when mounted over a garage doorway protects the existing garage door, reducing damage to the garage door by continually being struck by balls.

It is still another object of the present invention to provide in an embodiment a retractable rebounding surface that is larger than provided by conventionally available freestanding bounce back surfaces. In one embodiment the rebounding surface may be approximately six feet by six feet if suspended in a conventional one car garage opening, while in another embodiment the rebounding surface may be more than twice this width if adapted for double door garage applications. The size of the rebounding surface is customizable to fit different available spaces.

The invention provides a ball return system having a ball bounce back or rebounding surface which is larger than conventional rebounding surfaces and is retractable on a reel or roll back assembly into a storage housing, which housing in one embodiment is mountable above most conventional garage door openings. The bounce back or rebounding apparatus is set up for use by unrolling and lowering the rebounding surface on the reel assembly along with its integrated cable support structure either manually or via a motorized actuator assembly, down to a substantially upright position in front of or covering a garage door opening. The cable support is then connected to the garage door frame at connection points positioned in the lower right and left corners of the garage door frame, in one embodiment approximately twelve inches above the driveway, garage, or ground surface. The connection points are adjustable to allow the bounce back surface to be positioned at different degrees of angle with respect to a vertical plane, from angling forward to angling back, or centered in the middle for a perpendicular or vertical setting. Once connected at the attachment points, the cable system is then retracted, either manually or mechanically via the actuator assembly, to pull the cable taught, to allow for a strong support structure. This allows the rebounding surface to be set to the desired tension level, either manually or mechanically, to be used with different types of balls as well as to adjust the different performance levels with the same ball.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

Figure 1:
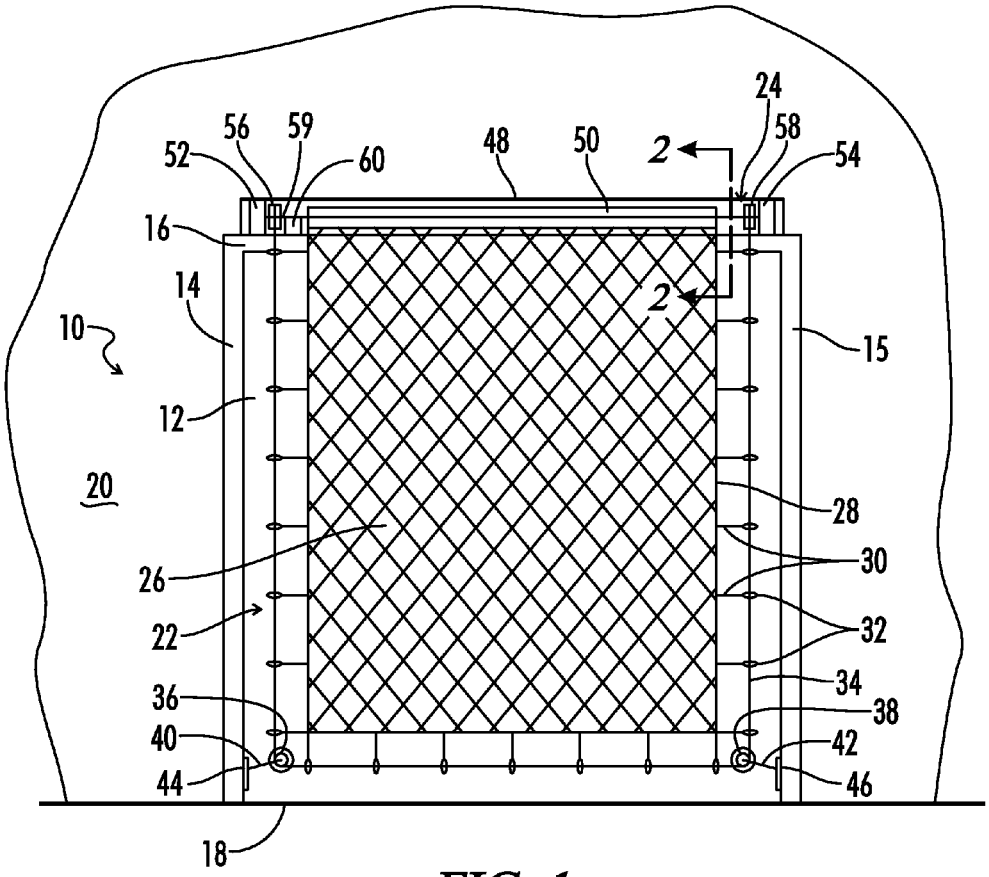
FIG. 1 illustrates an embodiment of the retractable ball return or bounce back apparatus and system of the present invention secured to a support structure with the rebounding surface in an extended position.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention. The components in the drawings are not necessarily drawn to scale, the emphasis instead being placed upon clearly illustrating the principles and manner of use of the invention. Moreover, in the drawings, like reference numerals designate corresponding parts throughout the several views. Wherever possible, the same reference numbers are used throughout the drawings to refer to the same or like elements of an embodiment.

As illustrated in FIG. 1, a structure or enclosure 10, which may be a residential home, condominium, apartment, or other building structure, has an opening 12 leading to the interior of the structure or enclosure 10, which opening 12 is typically but not limited to a garage opening of a type covered by a movable garage door. Opening 12 in the illustrated embodiment is defined by opposite vertical side frame sections 14 and 15, an upper cross piece 16 extending between side frame sections 14 and 15, and a ground or floor surface 18. It will be understood that opening 12 is merely exemplary and may another type of space or opening such as the area between a pair of pillars underneath a deck or support structure or other framework, or even a wide open space such as a gymnasium as long as a suitable support surface is provided for securing, tensioning, and adjusting the bounce back surface in the manner described herein.

Ball rebounder or bounce back system 20 generally includes a rebounding apparatus 22 for elastically rebounding a ball or other projectile forcibly thrust at a rebounding surface of the apparatus 22, and a reel assembly 24 which supports the rebounding apparatus 22 and is used to move the rebounding apparatus 22 between an extended use position (shown in FIG. 1) and a rolled up or retracted nonuse position. Rebounding apparatus 22 includes a rebounding or bounce back surface 26 having a reinforced peripheral edge 28 circumscribing the side and lower edges of the rebounding surface 26. Rebounding surface 26 in one embodiment is a netting made of a nylon material, although other materials such as woven fabrics and plastics may be used, while in other embodiments surface 26 may be a screen or mat. Peripheral edge 28 may also be made of a nylon or other material such as a metal cable, and may have a diameter and breaking strain which is greater than rebounding surface 26 in order to withstand the variable tension to be applied to the rebounding surface 26 during use as explained below. In one embodiment, the end pieces of the netting forming rebounding surface 26 may be secured together to form peripheral edge 28, while in another embodiment a separate elastic cord member may be secured between the outer edges of the netting.

Rebounding surface 26 may have a quadrilateral shape, and in one embodiment has a rectangular or square shape, although it will be understood that the outer periphery of rebounding surface 26 may be provided in other shapes such as round or oval while still falling within the intended scope of the invention. The dimensions of rebounding surface 26 may also be smaller or larger depending upon the size of the opening 12 in structure 10, but in general should be sized such that when deployed over opening 12 surface 26 is securable in a rigid or taut position so as to be able to create a forceful rebound effect on any balls thrown or directed at the rebounding surface 26.

Also included as part of rebounding apparatus 22 and connected to peripheral edge 28 of rebounding surface 26 in a spaced-apart relation are plurality of short extensions 30. Extensions 30 may also be made of a nylon cord or woven fabric material, and in one embodiment have a looped end 32. In addition, a support cable 34 is provided, and the looped ends 32 of extensions 30 are secured around support cable 34 so as to be laterally slidable on cable 34, which sliding movement facilitates the ability to adjust the tension on rebounding surface 26. In one embodiment, extensions 30 are made of an elastic material or other material and have a length such that when extensions 30 are secured between rebounding surface 26 and support cable 34, and the support cable 34 is secured as described below, the extensions 30 create a desired tension on the rebounding surface 26. In one embodiment, the tension on rebounding surface 26 via extensions 30 is adjustable by varying the length of the extensions 30. In one embodiment, extensions 30 may have hook members connected on their opposite ends with one hook member being secured to peripheral edge 28 of rebounding surface 26 and the other hook member being secured to support cable 34.

Support cable 34 in an embodiment is a flexible wire rope but in other embodiments may be made of other materials such as nylon or other strong woven material, or a plastic material. As shown in FIG. 1, support cable 34 extends in a spaced-apart relation along the side and bottom edges of peripheral edge 28 of rebounding surface 26, and is secured to opposite sides of reel assembly 24 on its ends, and more particularly in the illustrated embodiment to separate spaced-apart reels 56 and 58 forming part of reel assembly 24 as discussed in greater detail below. Pulley member 36 is connected to support cable 34 at a position near a lower corner of rebounding apparatus 26, and another pulley member 38 is similarly connected to cable 34 near an opposite lower corner of rebounding apparatus 22. In addition, an attachment member 40 is connected to pulley 36, while another attachment member 42 is similarly connected to pulley 38. In one embodiment attachment members 40 and 42 may be short flexible or non-flexible cords, and as will be explained in greater detail below are used to secure the lower ends or corners of support cable 34 to a pair of adjustable connectors 44 and 46 mounted on vertical frame sections 14 and 15 surrounding opening 12.

Figure 2:
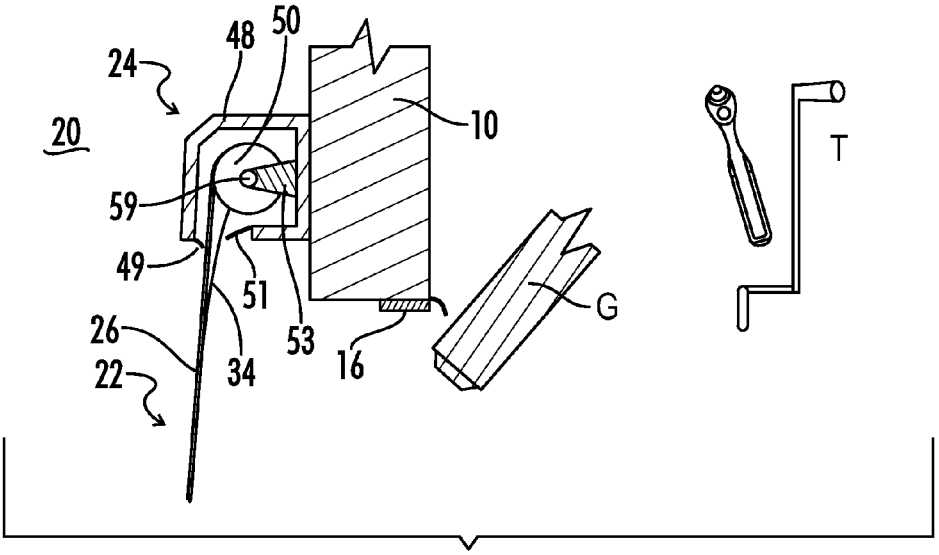
FIG. 2 is a cutaway view from the side of the retractable bounce back apparatus reel assembly and housing alone line 2-2 in FIG. 1.

As indicated above, rebounding apparatus 22 is retractably secured to a reel assembly 24, which as shown in FIGS. 1 and 2 includes a housing or enclosure 48 that is mountable in a horizontal orientation to structure 10 above cross piece 16 by suitable attachment members such as screws or the like (not shown). In such position, when the rebounding apparatus 22 is extended from enclosure 48, it will hang in a generally vertical orientation in front of opening 12 in structure 10, as well as in front of a garage door (G), shown in a partial view in FIG. 2 in a raised position, but when lowered garage door (G) would be situated behind apparatus 22 as viewed in FIG. 1.

As best shown in cross-section from the side in FIG. 2, housing 48 preferably substantially encloses the mechanical components of reel assembly 24 on its top and side surfaces. An opening 49 is provided on the underside of housing 48 through which rebounding apparatus 22 may be extended. Opening 49 may be at least partially covered by a plurality of flexible bristles or rubber pieces 51 which prevent dust and debris from entering housing 48 but still allow rebounding apparatus 22 be extended and retracted through opening 49.

Reel assembly 24 includes a centrally located reel or roller 50, which is supported in housing 48 on suitable support brackets 53. In one embodiment, reel 50 may be a tubular support member such as a hollow keyway tube. One end of rebounding surface 26 is securely connected to reel 50 such that when the reel 50 is rotated about its axis in one direction, the rebounding surface 26 is retracted and wrapped or rolled around the periphery of the reel 50. In addition, in a preferred embodiment, as shown in FIG. 1, the ends of support cable 34 are independently secured to separate smaller reels 56 and 58 positioned on opposite sides of reel 50. Support blocks 52 and 54 are positioned in housing 48 near its outer ends, and support a rod 59 that extends through reels 50, 56 and 58.

In one embodiment, rebounding apparatus 22 is extended out of housing 48 by manually grasping and then pulling downwardly on the outer end of the rebounding surface 26 or cable support 34, or a handle means attached to apparatus 22 may be provided. In another more preferred embodiment, reels 50, 56 and 58 are connected to separate ratchet means which includes a ratchet wheel and pawl system for engaging with the teeth of the ratchet wheel to prevent rotation in one direction. In such embodiment, tools such as tools T shown in FIG. 2, namely a ratchet or hand crank with torque settings, are used to turn the reels and extend the rebounding surface 26 and support cable 34, preferably in unison. The ratchet means of reels 50, 56 and 58 will be released so the reels are turned in a direction that allows the rebounding surface 26 and cable support 34 to be extended downwardly. A spring mechanism of a conventional type may also be fitted and supported within reel 50 such that when the rebounding surface 26 is caused to unroll or be extended, reel 50 is rotated about its axis which causes the spring mechanism to wind or become further tensioned. When apparatus 22 is released, the spring mechanism will then cause the rebounding surface 26 to be continually urged into a rewound position on reel 50 back onto itself. The spring mechanism may also include a locking means which prevents the spring from unwinding on itself unless it is unlocked.

Once rebounding apparatus 22 has been unrolled on reels 50, 56 and 58, and is urged by the tension spring to rotate in the opposite direction, the pawls will pivot so as to engage the ratchet wheel teeth to prevent further unrolling. Tools T may also be used to manually rotate reels 50, 56 and 58 in a direction that causes the rebounding surface 26 and support cable 34 to be retracted on reels 50, 56 and 58. Retracting the support cable 34 and rebounding surface 26 in addition to returning to a storage position in housing 48 also allows the tension on rebounding surface 26 to be adjusted when apparatus 22 is secured to attachment members 44 and 46, as described below.

In another embodiment, a motor 60 is arranged to extend and retract the rebounding apparatus 22, and a control unit (not shown) will be provided to control the operation of motor 60. In this embodiment, the rebounding apparatus 22 will be extended or deployed to the desired use position by activating motor 60, which motor 60 will cause reel 50 to rotate or turn about its axis in a first direction to unroll rebounding surface 26. Reels 56 and 58 in one embodiment will be designed to be rotatable as a result of the unrolling of rebounding surface 26 so that support cable 34 will also unwind as the rebounding surface 26 is caused to be lowered from housing 48 by motor 60. When the rebounding apparatus 22 is not in use, it can be returned to a retracted position by activating motor 60 to turn reel 50 on its axis in the opposite direction so that the rebounding apparatus is rolled up upon itself again, with support cable 34 also being rolled up on reels 56 and 58 at the same time.

Once apparatus 22 is extended and support cable 34 is secured to adjustable connectors 44 and 46 by attachment cords 40 and 42 in the manner described below, the rebounding surface 26 may be further tensioned by reversing the direction of motor 60 to cause the rebounding surface 26 and support cable 34 to retract while the structure is also maintained in an extended use position. Further tension can be applied by rotating reel 50 in the direction of retraction. Thus, tension can be readily applied to the rebounding surface 26, and may be easily varied by adjusting the amount of rotation of reel 50, which in turn will vary the amount of retraction of rebounding surface 26.

In addition, motor 60 or in another embodiment a separate actuator means is operably connected to reels 56 and 58 in order to adjust the tension on support cable 34 independently of reel 50 and rebounding surface 26. In one embodiment, tension can be applied to the ends of support cable 34 attached to reels 56 and 58, respectively, independent and separate from each other as well as from reel 50, by causing one or both reels 56 and 58 to rotate in a direction such that the support cable is further retracted. The manner of applying tension to cables 34 thus can be the same as the manner in which tension is to be applied to the reel 50, however, in a preferred embodiment the tension applied to the cables 34 and the rotating reel 50 function independently from one another. It will be understood that motor 60 as well as any additional motors will be of a type that is able to apply sufficient torque to retract the rebounding surface 26 and support cables 34 and in addition to provide the desired amount of tension on rebounding surface 26 so that it is deployable under the desired varying tension.

In one embodiment, the length of extensions 30 is adjustable in order to vary the overall tension on rebounding surface 26. In particular, in some cases where rebounding surface 26 includes an elastic material, over time the elasticity of the material may lessen in which case extensions 30 may be shortened or replaced to compensate for such elasticity loss. Extensions 30 may also be adjusted if necessary so that the tension is applied evenly to both sides of the rebounding surface 26.

Figure 3:
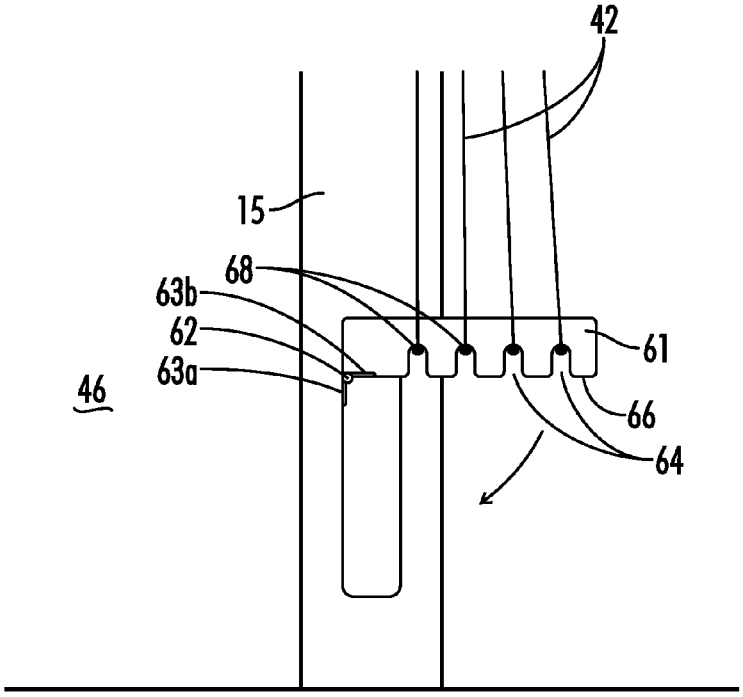
FIG. 3 is an elevation view of an embodiment of an adjustable connector or securing device used in accordance with the invention.

FIG. 3 illustrates an embodiment of one of the adjustable connectors 44 and 46 used to secure the lower end of the rebounding apparatus 22 to vertical frame sections 14 and 15 surrounding opening 12 of structure 10, respectively, in order to hold the rebounding surface 26 in an extended position and taut. Connectors 44 and 46 also provide a means for adjusting or varying the angle of the rebounding surface 26 and therefore the angle of return of any balls or projectiles which contact the rebounding surface 26. In the presently described embodiment, each connector 44, 46 includes a pivotable arm member 61 which is secured to frame section 14, 15 respectively by a swivel connection member 62 having a first leg 63*a* connected to frame section 14, 15 and a second leg 63*b* connected to arm member 61. As shown in FIG. 3, arm member 61 is swiveled or rotated from a vertical storage or non-use position towards the outside of frame section 15. In one embodiment, the swivel connector 62 has a range of rotation of no more than ninety degrees so that arm member 61 cannot rotate outwardly beyond a horizontal position, while in another embodiment arm member 61 may be locked at different angles.

A plurality of spaced apart notches 64 are provided in first side surface 66 of arm member 61, such that notches 64 are facing or open downwardly when the arm member 61 is pivoted into a horizontal position as shown in FIG. 3. In another embodiment, illustrated in FIG. 4, the side surface 68 opposite surface 66 also contains a plurality of spaced apart notches 70, and is connected to frame section 14, 15 by a swivel connector 72 that allows the arm member 61 to swivel either to the inside or to the outside of the garage or structure opening 12, as well as to be locked in either position, either manually via a bolt means or the like, or automatically via a locking mechanism. Thus, in the embodiment shown in FIG. 4, in either an inward or outward pivot position, the notches 64 or 70 on one of the side surfaces 66 or 68 of arm 61 will be facing downwardly toward the garage or ground surface.

In another embodiment, not shown, attachment members 44 and 46 may also include a first plate or arm which is rigidly secured to the structure frame section 14 or 15, and a second swivelable or pivoting arm 61 which is joined to the first arm by a pivot such as pivot 62. A locking mechanism for securing arm 61 in a storage position in parallel with frame section 14 or 15 is also preferably provided, which may be comprised of a simple notch or detent in the connection end of arm 61 that when it comes into contact with one or more spring loaded ball members or the like on the first arm, the ball member will enter the notch. Thus, when arm 62 is pivoted into either a horizontal use position as well as in one embodiment a vertical storage position, the ball member is forced into the notch or detent, locking the arm in such position. Other locking arrangements such as a slip joint, liner-lock, or lock-back may also be provided.

Figure 4:
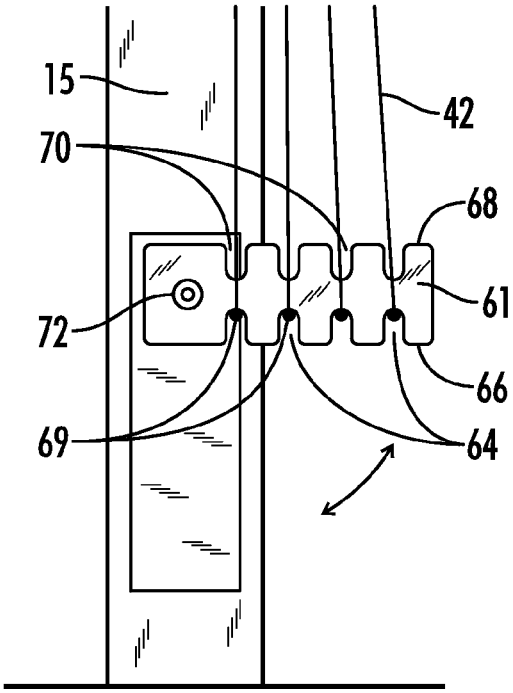
FIG. 4 is a side view of an alternative adjustable connector or securing device.
Figure 5:
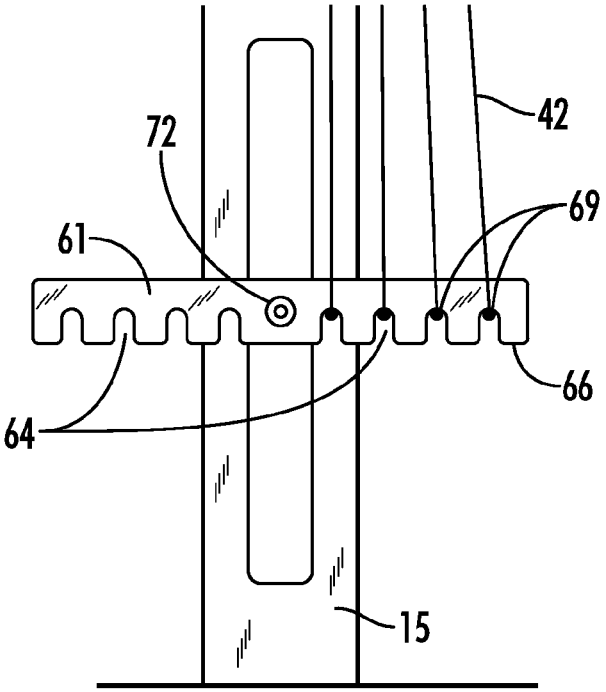
FIG. 5 is a side view of another alternative adjustable connector or securing device.

In yet another embodiment, illustrated in FIG. 5, arm member 61 is elongated as compared to the similar arm member shown in FIG. 3, and is pivotable about a pivot connection to section 14, 15 at a central location similar to the embodiment disclosed in FIG. 4. In FIG. 5, the notches 64 on side 66 of arm member 61 extend both inwardly and outwardly with respect to the structure 14, 15 when the arm member is pivoted from a vertical storage position to a horizontal use position.

Upon rebounding apparatus 22 being extended from housing 48 of reel assembly 24 in the manner described above, prior to applying additional tension to the rebounding apparatus 22, connectors 40 and 42, which have an enlarged section 69 formed either as a knot or other suitable hook or ball-like attachment or connector on their outer ends, are positioned with the enlarged section 69 being passed into one of the notches 64 or 70 in arm member 61 so that the enlarged section 69 extends out the opposite side of the notch. Preferably, the enlarged sections 69 will be adapted to be maintained in notches 64 or 70 without any tension being applied on the connectors 40 and 42 in order to make it easier to use the apparatus of the invention. In any event, the application of an upwardly directed tension on connectors 40 and 42 will cause the enlarged ends 69 of the connectors to catch and be held in the selected notch.

Once the lower end of rebounding apparatus 22 is secured with enlarged sections 69 of connectors 40 and 42 having been passed into one of the notches 64 or 71 on arms 61, the tension on rebounding surface 26 may be increased or adjusted by reversing the direction of reel 50 and retracting the support cable 34 and rebounding surface 22 back into housing 48. In a preferred embodiment, first the support cable 34 of rebounding apparatus 22 is retracted on reels 56 and 58. Once the support cable 34 is retracted initially, the rebounding surface 26 will then also be retracted until the desired tension is achieved. As indicated above, the reel assembly 24 and more particularly reels 50, 56 and 58 are provided with a locking means, preferably a ratchet-type means, so that as the tension on the rebounding apparatus 22 is increased, the reels cannot reverse direction under such tension. As the tension is increased on support cable 34 as it is retracted on reels 56 and 58, pulleys 36 and 38 positioned along the lower ends of support cable 34 ensure that the tension on the support cable 34 is evenly distributed. In addition, the looped sections 32 of connectors 30 ensure that as the tension is increased on cable 34 and then also on rebounding surface 26, such tension is evenly distributed on the rebounding surface, as the connectors are free to slide on cable 34.

Depending on the selected notches 64 or 70 in arm 61 in which the enlarged section 69 of connectors 40 and 42 are inserted, the angle of rebounding surface 26 may be varied, which in turn allows the angle of return or bounce back angle of a ball thrown or thrust at rebounding surface 26 to also be varied. As an example, if a high rebound or return angle is desired, arm 61 will be pivoted outwardly from opening 12 and one of the notches furthest from the pivot position may be used. Alternatively, if a negative or downward return angle is desired, so as to simulate a ground ball in baseball or the like, the arm 61 may be pivoted so that it is directed inwardly or toward opening 12. It will also be understood that the return or rebound angle may also be adjusted so as to be to the left or right by varying or securing the attachment cords 40 and 42 in different notches 64 or 70 on arm 61 of attachment member 44 than are used on attachment member 46. This may be particularly useful in practicing catching or throwing a ball to the left or right of a center position, or if a person other than the one directing the ball at the rebounding surface is to be the one catching or retrieving the rebounded ball.

Notches 64 are shown in FIG. 3 as having a rounded shape; however, it will be understood that notches 64 may have other shapes such as a V-shape. Other arrangements for securing the lower ends of rebounding apparatus 22 taut and for varying the rebound or return angle of the rebounding surface may also be provided. Thus, in at least one embodiment, the bounce back or return angle of the rebounding surface can be adjusted to either a positive or negative angle, so as to create an upward return or a downward return, or can be kept at a perpendicular angle to achieve a direct return. This allows for simulation of baseball play ranging from pop flies to grounders, or returning a tennis ball by angling it down so that it hits the ground surface prior to returning to the person, replicating actual tennis play. Another example is replicating a bounce pass in basketball versus a no bounce pass.

The retractable bounce back or rebounding apparatus and system of the present invention thus provides a rebounding surface that can be used with a wide variety of different types of balls, although it is believed to be most conducive to use in sports such as lacrosse, baseball, basketball, soccer, tennis, street hockey, racket ball and softball. The retractable bounce back apparatus is easy to deploy for use in that all that is required is for the rebounding surface or netting to be extended from the reel assembly, and for the lower end of the support cable to be connected to the frame sections of the garage opening or the like at two points so that the bounce-back is positioned at the desired angle. Then, the tension on the rebounding surface is easily adjusted by first retracting the support cable to a desired tension, and then the rebounding surface. When mounted over a garage doorway and extended over the doorway opening in a use position, the rebounding surface by its placement is located in front of the hard driveway surface which maximizes play of certain games such as tennis and baseball, as opposed to being located in the grass. In addition, the rebounding apparatus inherently protects the existing garage door, such that the cost of the rebounding apparatus is substantially offset by the cost savings of not having to replace a garage door damaged by continually being struck by balls as a result of normal game play on a driveway, which is an outdoor surface where kids like to play.

Figure 6:
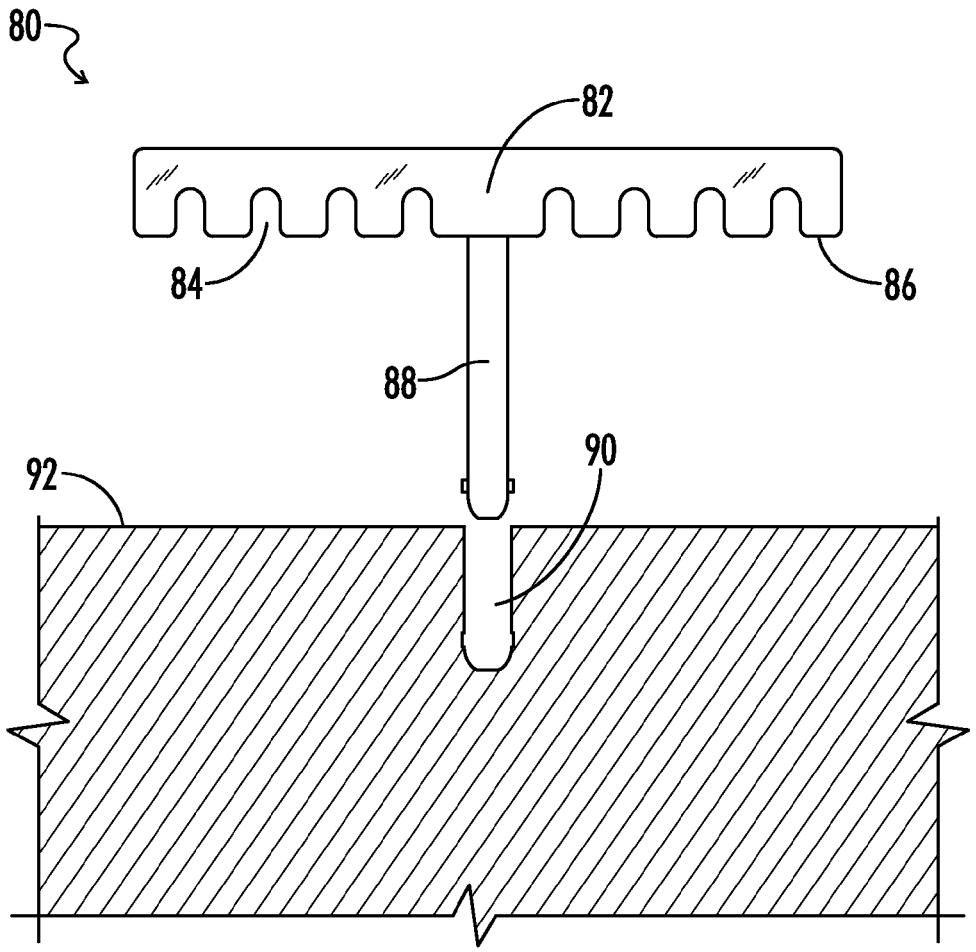
FIG. 6 is partial cross-sectional side view of another alternative adjustable connector for use with the invention in a gymnasium or other ground surface.

In another embodiment, the bounce back apparatus and system of the present invention may also be set up in large open areas such as a gymnasium. This deployment requires a support surface for mounting of the reel assembly 24 with housing 48 in a horizontal position above the gym floor at a suitable height. When the rebounding apparatus 22 is unrolled or deployed downwardly in the manner described above, the attachment members 40 and 42 may be secured to connectors or attachment members that are connectable to the gym floor. FIG. 6 illustrates an embodiment in which an attachment member 80 has an arm section 82 having a plurality of notches 84 in its lower side surface 86, and a spring-loaded ball connector extending from arm section 82. A tubular pin receiving mount 90 is permanently mounted in the gym floor surface 92 at suitable positions so that when pin 88 is inserted into receiving mount 90, arm section 82 is positioned in close proximity to the gym surface where the connectors 42 and 44 may be secured as described above. A cover may be provided to cover mount 90 when the bounce-back apparatus is not in use. Alternatively, a temporary support to which the attachment members are secured may be provided where it is not practical to permanently mount connectors in the floor.

In another embodiment, the bounce back apparatus reel assembly housing may be secured in close proximity to the gymnasium wall, and connectors for the attachment members may be mounted to the wall surface in a suitable position. The attachment members may pivot outwardly from the wall surface in a manner similar to that shown in FIG. 3, except that the attachment members may be longer depending upon how far away from the wall the reel assembly is mounted or positioned. In addition, the attachment members may have a greater number of notches in which the enlarged ends of the attachment members are secured, with some of the notches positioned to support the lower end of the rebounding surface at a negative angle, several positioned to hold it at different positive angles, and one to support the rebounding surface in a substantially vertical position.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

What is claimed is:

1. A ball rebounder system comprising:

a) a reel assembly including a rotatable reel;

b) a rebounding apparatus having a first end and a second end in which the second end is attached to said reel assembly such that the rebounding apparatus may be extended or retracted on said rotatable reel, and including a rebounding surface;

c) a support cable connected on its ends to said reel assembly and slidably secured extending around the first end and sides of said rebounding surface to short extensions attached to the periphery of the rebounding surface such that the support cable is spaced apart from the first end and sides of the rebounding surface when the rebounding apparatus is in an extended position;

d) a plurality of cords each connected to a pulley secured to the support cable in close proximity to said first end;

e) a plurality of adjustable connectors attached to a support structure to which said cords are detachably secured when the rebounding apparatus is in an extended position, said connectors each including a frame section attached to the support structure and an arm member pivotably attached to the frame section, said arm member having a plurality of spaced apart notches on at least one side surface, and being lockable in a horizontal use position in which a side surface containing said notches is facing downwardly, said notches comprising different attachment locations for the cords and providing at least two different settings for varying the angle of the rebounding surface;

f) said reel assembly being operated to secured the support cable and second end of the rebounding apparatus at different extended positions in order to adjust the tension on the rebounding surface when the cords are secured to said adjustable connectors.

2. The ball rebounder system of claim 1 in which the use of different attachment locations allows the angle of the rebound surface to be secured at a positive or negative angle with respect to vertical.

3. The ball rebounder system of claim 1 additionally comprising a motorized actuator operatively connected to said reel assembly for extending and retracting as well as adjusting the tension of said rebounding apparatus.

4. The ball rebounder system of claim 2 in which the cords are selectively securable to the attachment locations such that the rebound surface is angled to cause a ball thrust at the rebound surface to rebound to the left of center or to the right of center.

5. A retractable reeled sports practice rebound system comprising:

a rebounding apparatus having a surface adapted to withstand the impact of a sports ball forcibly thrust at the surface, and positionable for use in a location substantially covering an opening, a housing, said housing enclosing a reel assembly including a retractable reel, configured to extend, retract, and lock in a given position, an upper end of the rebounding apparatus being permanently secured to the retractable reel, a support cable connected on its ends to the reel assembly and slidably secured to the rebounding surface by short extensions attached around the periphery of the rebounding surface in which the tension on the rebounding surface can be incrementally increased and decreased by adjusting the locked position of the reel assembly, separate motorized actuators for independently controlling deployment and retracting of the support cable and rebounding apparatus, connectors for releasably connecting a lower end of the rebounding apparatus when in an extended position to a support surface adjacent said opening, said connectors each including a plurality of horizontally spaced attachment locations such that the angle of the rebounding surface is adjustable by securing the lower end of the rebounding apparatus to different combinations of attachment locations on each connector, including a plurality of angles relative to a vertical angle, and a plurality of angles such that a ball thrust at the rebound surface will selectively rebound to the left of a center position, to the right of a center position, or a center position, said rebounding surface having a tension which is adjustable to accommodate use of the sports practice rebound apparatus with different types of sports projectiles by adjusting the locked position of the retractable reel.

6. The sports practice rebound system of claim 5 in which the plurality of attachment locations enable the rebounding surface to be positioned at angles ranging between a positive angle relative to vertical and a negative angle relative to vertical.

7. The sports practice rebound system of claim 5 further comprising a cable which surrounds and supports the rebounding surface.

8. The sports practice rebound system of claim 7 in which the lower end of the rebounding apparatus is secured to the connectors by a flexible cord secured to the support cable.

9. The sports practice rebound system of claim 8 in which the flexible cord is secured on one end to a pulley connected to the support cable, and having an enlarged opposite end which is secured over one of the attachment locations.

10. The sports practice rebound system of claim 9 in which the connectors each include a frame section attached to the support surface, and an arm member pivotally attached to the frame section and being pivotable into a horizontal use position in which one or more notches are located on a downwardly facing side surface of the arm member.

11. The sports practice rebound system of claim 7 in which the frame section is a pin member.

* * * * *